US006139218A

United States Patent [19]

Cochran

[11] Patent Number: 6,139,218

[45] **Date of Patent: *Oct. 31, 2000**

[54] VIBRATING MECHANISM

[76] Inventor: Gary Cochran, 302 N. Forrest Lakes, Wichita, Kans. 67205

[ * ] Notice: This patent issued on a continued prosecution application filed under 37 CFR 1.53(d), and is subject to the twenty year patent term provisions of 35 U.S.C. 154(a)(2).

[21] Appl. No.: 09/127,590

[22] Filed: Jul. 31, 1998

[51] Int. Cl.[7] ..... E01C 19/38

[52] U.S. Cl. ..... 404/113; 404/133.05; 404/133.2; 74/61

[58] Field of Search ..... 404/117, 133.05, 404/133.1, 133.2, 113, 114; 74/61

[56] References Cited

U.S. PATENT DOCUMENTS

| | | | |
|---|---|---|---|
| 1,827,586 | 10/1931 | Keefer . | |
| 1,999,213 | 4/1935 | Shaler . | |
| 2,737,094 | 3/1956 | Jackson . | |
| 2,840,354 | 6/1958 | McKellar . | |
| 3,417,966 | 12/1968 | Bodine . | |
| 3,817,646 | 6/1974 | Opderbeck | 404/133.1 |
| 3,832,080 | 8/1974 | Stoecker | 404/133.1 |
| 4,050,527 | 9/1977 | Lebelle | 173/49 |
| 4,285,405 | 8/1981 | Weir, Jr. | 173/162.1 |
| 4,793,196 | 12/1988 | Davis et al. | 74/61 |
| 5,220,845 | 6/1993 | Anderson | 4/13.1 |
| 5,248,216 | 9/1993 | Vural | 404/75 |
| 5,860,321 | 1/1999 | Williams et al. | 74/143 |

*Primary Examiner*—James A. Lisehora
*Attorney, Agent, or Firm*—Kenneth H. Jack; Davis & Jack, L.L.C.

[57] ABSTRACT

A vibrating mechanism comprising a housing having a lower end and having an interior space; an imbalanced wheel having a right side, a left side, an axis of rotation, and a plane of rotation situated between the left and right sides, the plane of rotation extending perpendicularly outward from the axis of rotation; a drive axle rotatably mounting and positioning the imbalanced wheel within the interior space of the housing so that the plane of rotation extends through the lower end of the housing; and an apertured base plate capable of alternately fixedly attaching the lower end of the housing to and removing the lower end of the housing from an earth compacting machine, the apertured base plate being fixedly attached to the lower end of the housing.

4 Claims, 5 Drawing Sheets

VIBRATING MECHANISM

FIELD OF THE INVENTION

This invention relates to earth compacting machines. More particularly this invention relates to mechanisms adapted for inducing vibratory motion of earth compacting plates of earth compacting machines.

BACKGROUND OF THE INVENTION

Construction contractors and excavation contracting companies commonly maintain and utilize several different types of earth moving equipment. For example, excavation contracting companies commonly maintain and utilize track driven excavators, front loader/backhoe trackers, and skid steer tractors. An earth working implement commonly attached to the boom arm or lift arms of such earth moving equipment is a "bucket" utilized for digging, scooping, and moving dirt. Such an implement may easily be removed and interchanged with various types of hydraulically powered auxiliary earth working implements. For example, a hydraulically driven jack hammer may be mounted upon the end of the boom arm of an excavator or tractor backhoe. As another example, a hydraulically driven road grinding or planing machine may be mounted upon the lift arms of a front loader tractor or skid steer tractor. Hydraulic motor driven earth compacting vibrators are similarly attachable as an auxiliary implement either to the lift arms of a front loader tractor or skid steer tractor, or to the boom arm of an excavator or backhoe tractor.

Such auxiliary earth compacting implements commonly comprise a heavy off balanced or imbalanced steel wheel which is rotatably driven by an hydraulic motor. Such imbalanced wheel and hydraulic motor assemblies commonly rotate within a frame or housing having a lower compaction plate, the frame or housing being attached to a boom arm or lift arm. Rotation of the wheel of such assembly imparts vibratory motion to the compaction plate, and to compactable soil or sand underlying the compaction plate.

A drawback or disadvantage common to such auxiliary earth compacting implements is that they are expensive to obtain and maintain. An excavation contracting company seeking to outfit several excavators, front loader/backhoe tractors, and skid steer tractors with auxiliary earth compactors must purchase and maintain a vibrator assembly such as is described above as an integral part of each auxiliary implement. In the event the vibrator assembly of such an auxiliary compactor becomes damaged or is in need of maintenance, the auxiliary compactor implement is necessarily put out of commission while repair or maintenance work is performed.

The instant inventive vibrating mechanism solves the above described problems by providing an hydraulic motor driven vibrator unit which is interchangeably attachable to and removable from several different auxiliary earth compacting implements. Through utilization of a single unit of instant inventive vibrating mechanism, several different auxiliary earth compactors may be rendered functional. Thus, alternate and interchangeable utilization of the instant inventive vibrating mechanism results in cost economy. In the event one of the instant inventive vibrating mechanisms is in need of repair or maintenance, further cost economies are realized as a result of transferability of a similar vibrating mechanisms installed within other auxiliary earth compactors.

BRIEF SUMMARY OF THE INVENTION

The instant inventive vibrating mechanism preferably comprises a pair of counter-rotating off-balanced gears which are rotatably mounted within an occlusively closed oil containing gear housing. Preferably, the gears form an in line train, and have equivalent diameters and weights. Also preferably, each of the gears has semi-circular indentations, or other differently configured material voids, within its side walls causing their centers of gravity to be radially removed from their axes of rotation. Also preferably, the gears are in synchronized engagement so that as the center of gravity of one of the gears reaches its lowest elevation, the center of gravity of the other gear simultaneously reaches its lowest elevation. Such synchronized orientation of the two off-balanced gears cancels out undesirable lateral vibratory motion and enhances desired vertical vibratory motion.

Rotary support of the pair of off-balanced gears is preferably provided by a hollow steel housing which is cast as two pieces which take the form of a downwardly opening oblongated cap and an upwardly opening oblongated bowl. The interior longitudinal dimensions of the oblongated cap and the oblongated bowl are necessarily of sufficient length to accommodate the two in line off-balanced gears. The lower lip of the oblongated cap and the upper lip of the oblongated bowl preferably are cast to form outwardly extending structural reinforcement flanges, such flanges being closely fitted for fixed attachment to each other by means of threaded bolts, such bolts preferably being mounted within spirally threaded apertures extending through such flanges. The side walls of the housing are preferably cast to form circular mounting surfaces for retaining axle bearings for rotatable support of the off-balanced gears. Also preferably, the lower end of the housing is cast to form a pair of rectangular base plates which extend laterally from the side walls of the housing, the base plates having bolt receiving apertures therethrough. Through utilization of the bolt receiving apertures of the base plates, the housing may be conveniently bolted on to the compaction plate of any one of several different auxiliary hydraulic compactors. At least one of the off-balanced gears preferably has a drive axle whose end is exposed at the exterior surface of the housing, such end preferably providing a drive linkage to which the drive shaft of an hydraulic motor is attached.

Accordingly, it is an object of the present invention to provide a vibrating mechanism for auxiliary earth compacting machines which may be conveniently installed in and removed from any one of several earth compacting machines.

Other and further objects, benefits, and advantages of the present invention will become known to those skilled in the art upon review of the Detailed Description which follows and upon review of the appended drawings.

BRIEF DESCRIPTION OF THE DRAWINGS

Drawing

Drawing

Drawing

Drawing

Drawing

DETAILED DESCRIPTION OF THE PREFERRED EMBODIMENT

Figure 1:
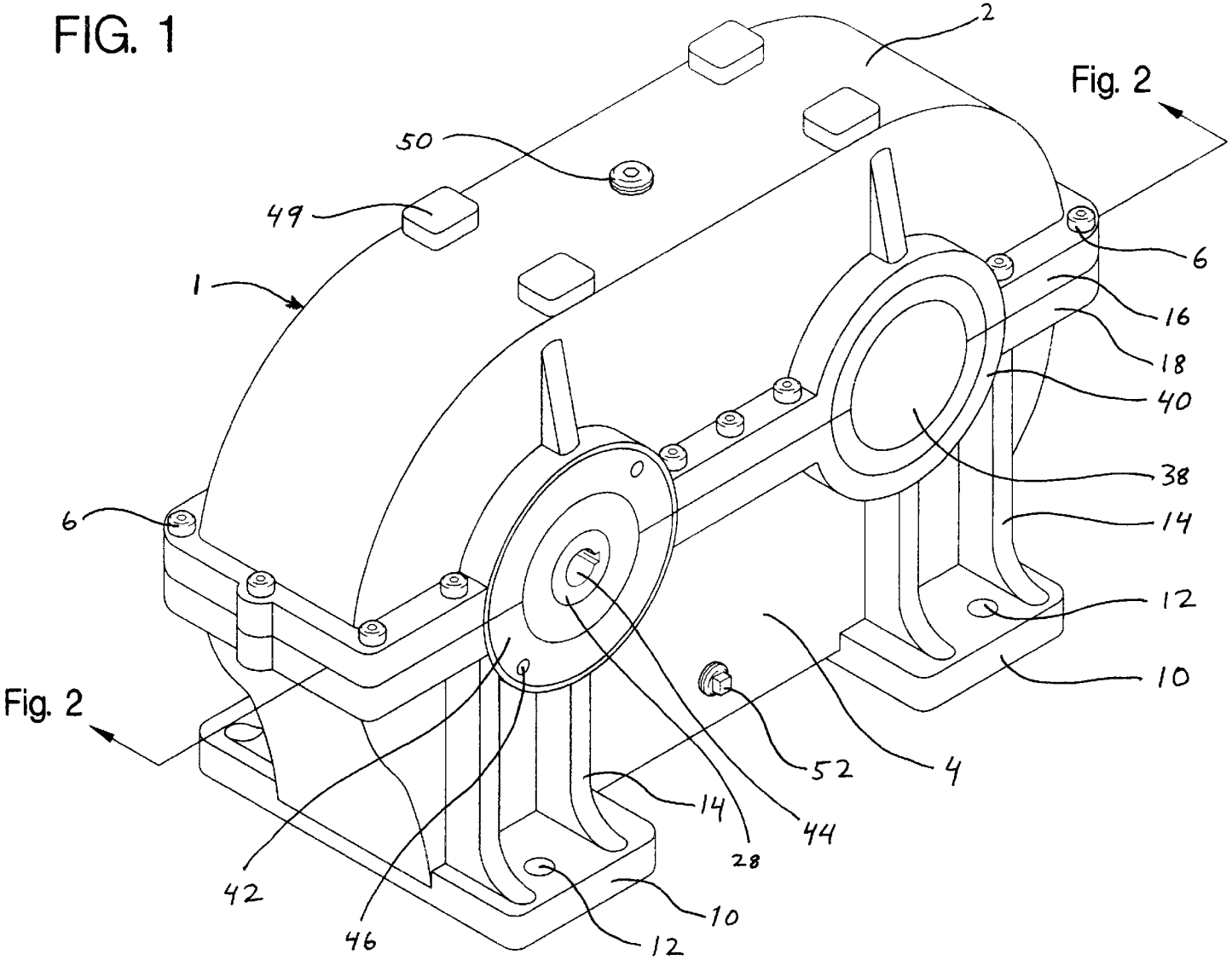
FIG. 1 is an isometric view of the present inventive vibrating mechanism.
Figure 2:
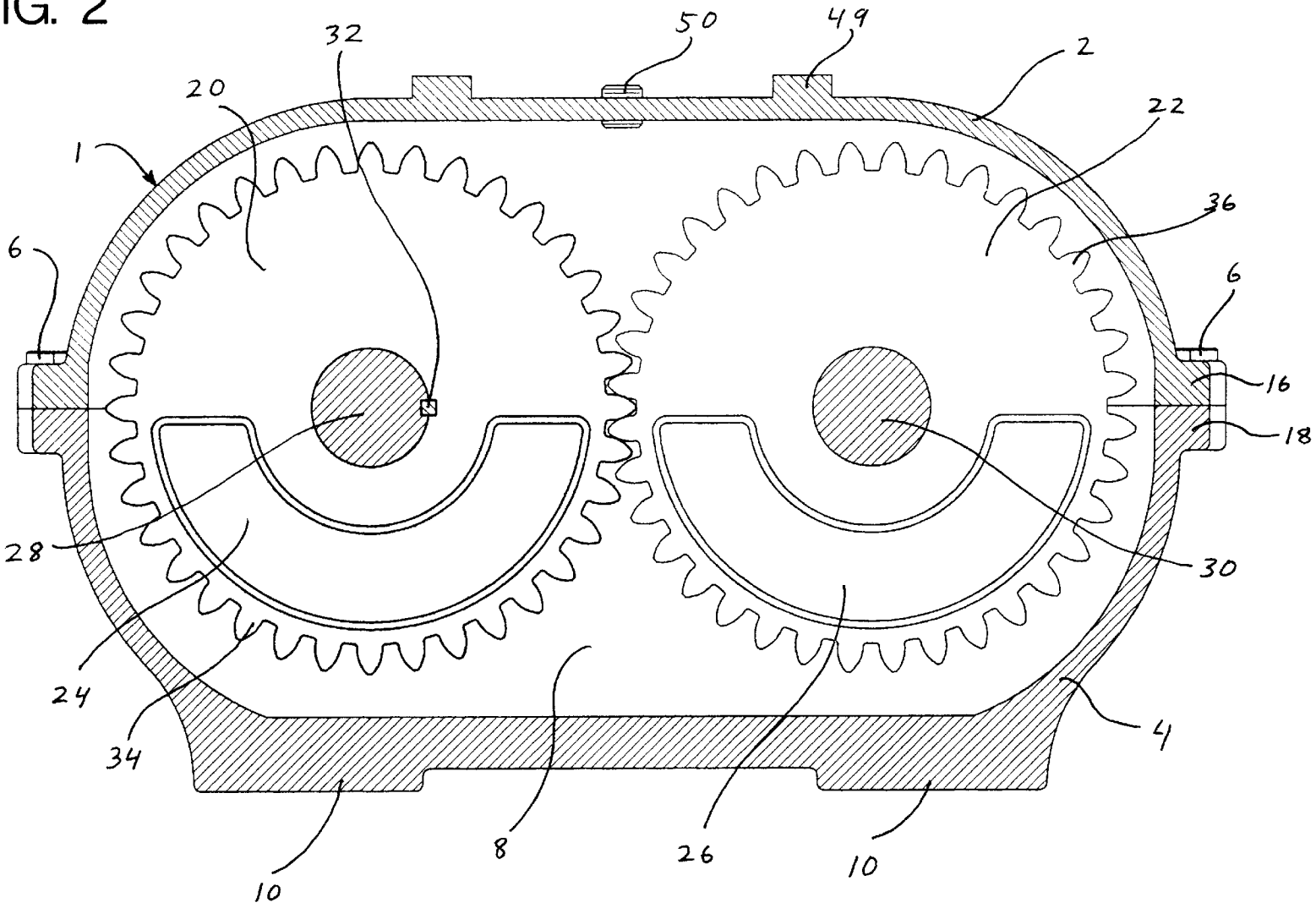
FIG. 2 is a side sectional view of the present inventive vibrating mechanism.

Referring now to the drawings, and in particular to Drawing FIG. 1, the present inventive vibrating mechanism is referred to generally by Drawing Element 1. Referring simultaneously to FIGS. 1 and 2, an oblongated cast steel cap 2 and an oblongated cast steel bowl 4 are fixedly attached to each other by means of threaded allen-headed bolts 6, such cap 2 and bowl 4 defining and hermetically closing an oil containing interior gear space 8.

Figure 3:
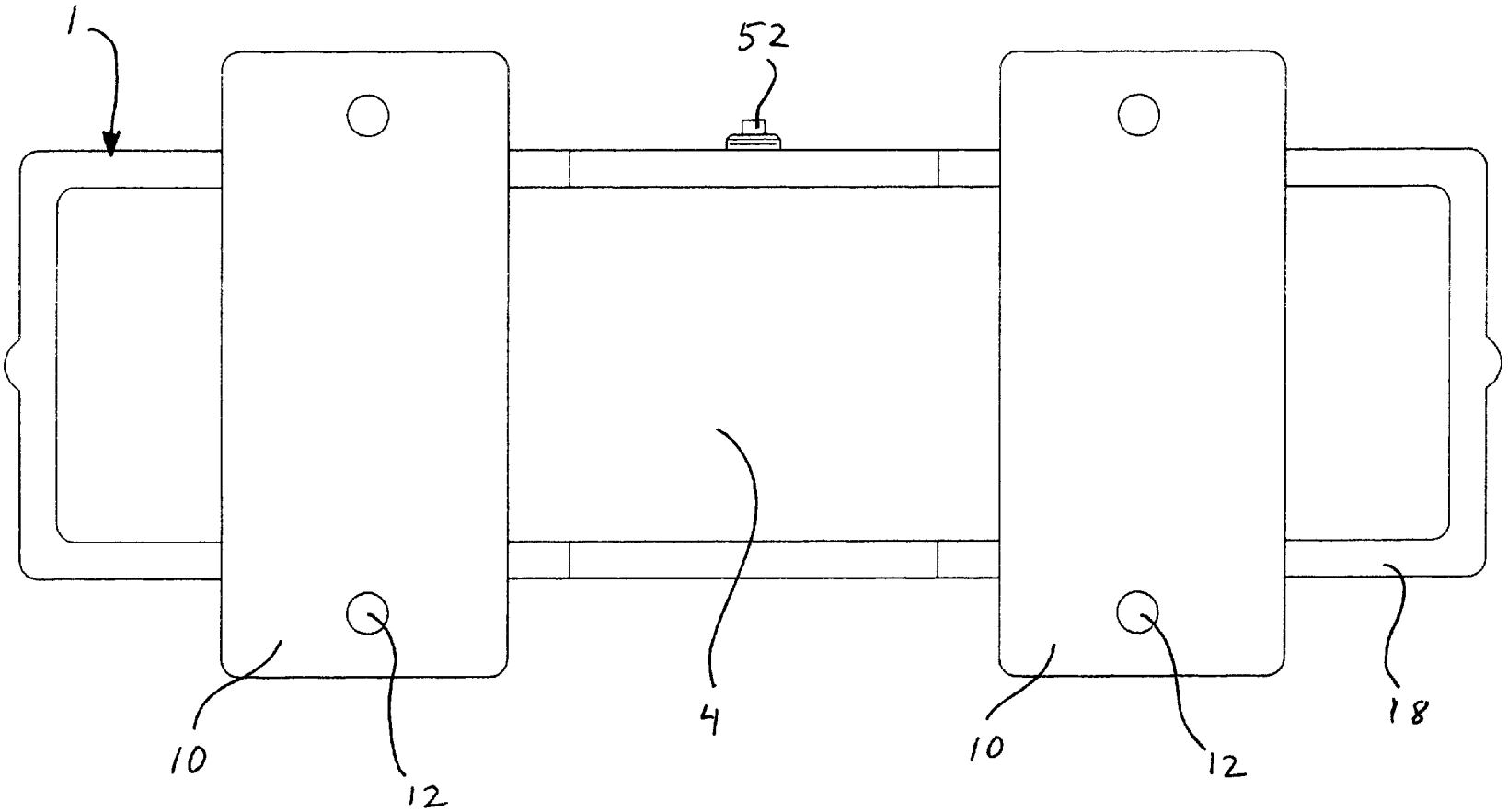
FIG. 3 is a bottom view of the present inventive vibrating mechanism.

Referring simultaneously to FIGS. 1 and 3, the lower end of the oblongated bowl 4 is preferably cast to form a pair of laterally protruding base plates 10, each base plate 10 preferably having a bolt receiving aperture 12 therethrough. The base plates 10 provide a stable support for mounting of the vibrating mechanism 1 upon an upwardly facing surface of an earth compactor compaction plate, and the bolt receiving apertures 12 provide a convenient means for alternately bolting in place and removing the vibrating mechanism 1.

Referring to FIG. 1, structural rigidity of the upper structure of the vibrating mechanism 1 with respect to the base plates 10 is enhanced by casting the oblongated bowl 4 to form reinforcement flanges 14 which extend upwardly from the upper surfaces of the base plates 10. Similarly, structural rigidity of the lips of the oblongated cap 2 and the oblongated bowl 4 is enhanced by casting them to form outwardly extending flanges 16 and 18, which flanges also provide a convenient strata for threaded mounting of the allen-headed bolts 6.

Referring to FIG. 2, rotatably mounted within the interior gear space 8 is a toothed drive wheel (or gear) 20 and a free turning gear 22. Material voids provided by indentations 24 and 26, which extend respectively into the opposing side walls of the drive gear 20 and the free turning gear 22, shift the centers of gravity of the drive gear 20 and the free turning gear 22 radially away from their axes of rotation. As depicted in FIG. 2, the center of gravity of the drive gear 20 lies directly above its drive axle 28, and the center of gravity of the free turning gear 22 lies directly above its axle 30. Rotational torque applied to the drive axle 28 is transmitted to the drive gear 20 via a key 32, allowing the teeth 34 of the drive gear 20 to engage the teeth 36 of the free turning gear 22, counter-rotating the free turning gear 22. Engagement of the gear teeth 36 of the free turning gear 22 with the gear teeth 34 of the drive gear 20 synchronizes the counter-rotating motion of such gears, cancelling any undesirable lateral vibratory motion, and enhancing desired vertical vibratory motion.

Figure 4:
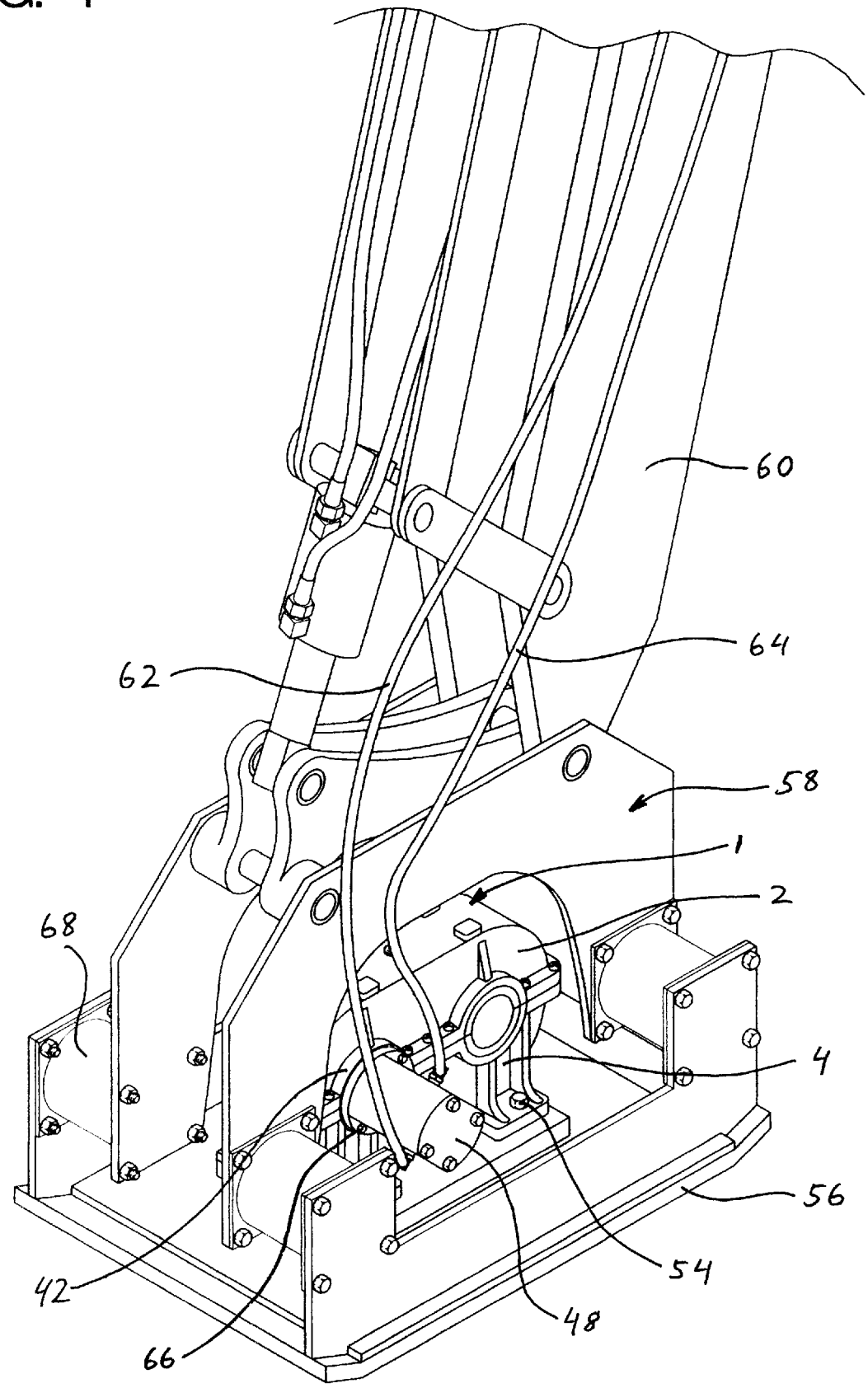
FIG. 4 depicts an exemplary use of the present inventive vibrating mechanism.

Referring simultaneously to FIGS. 1 and 2, the ends of the axle 30 nest within inwardly facing surfaces of bearings 38, the bearings 38 being securely mounted within circular bearing supporting collars 40, which collars are cast as a part of the oblongated cap 2 and the oblongated bowl 4. Further referring to FIGS. 1 and 2, the drive axle 28 is similarly mounted within bearings mounted within bearing supporting collars 42. The exposed end of the drive axle 28 preferably has an indentation 44 which is fitted for receiving a keyed drive shaft of, referring to FIG. 4, an hydraulic motor 48. Referring simultaneously to FIGS. 1 and 4, the outwardly facing surface of the bearing supporting collar 42 has fittings 46 which facilitate fixed attachment thereto of the hydraulic motor 48.

Referring to FIG. 1, a spirally threaded allen-headed plug 50 may be removed, opening a lubrication fluid input aperture, such aperture being utilizable for introduction of lubricants into, referring to FIG. 2, the interior gear space 8. Referring further to FIG. 1, a similar plug 52 allows drainage of such fluids without inversion of the mechanism 1. The upper surface of the oblongated cap 2 preferably has four upwardly protruding feet 49 allowing the vibrating mechanism 1 to be conveniently inverted and placed upon a flat surface for maintenance and implement installation, without applying pressure to the plug 50.

Referring to FIG. 4, the vibrating mechanism 1 may be conveniently mounted by means of bolts 54 to the compaction plate 56 of an auxiliary earth compactor 58 which is mounted upon the end of a boom arm 60 of an excavator (not shown in view). As depicted in FIG. 4, hydraulic power provided by hydraulic lines 62 and 64 drives the hydraulic motor 48 which is fixedly attached to the bearing supporting collar 42 of the vibrating mechanism 1 by means of screws 66. Referring simultaneously to FIGS. 1, 2 and 4, the hydraulic motor 48 turns its drive shaft (not shown in view), which rotates the drive axle 28, counter-rotating the drive gear 20 and the free turning gear 22. Vertical vibratory motion is transmitted from the gears 20 and 22 to the oblongated cap 2 and to the oblongated bowl 4. Thence, such vibratory motion is transmitted to the compaction plate 56, for compaction of underlying ground material. Rubber shock absorbing mounts 68 minimize transmission of vibrating motion from the vibrating mechanism 1 to the boom arm 60.

Figure 5:
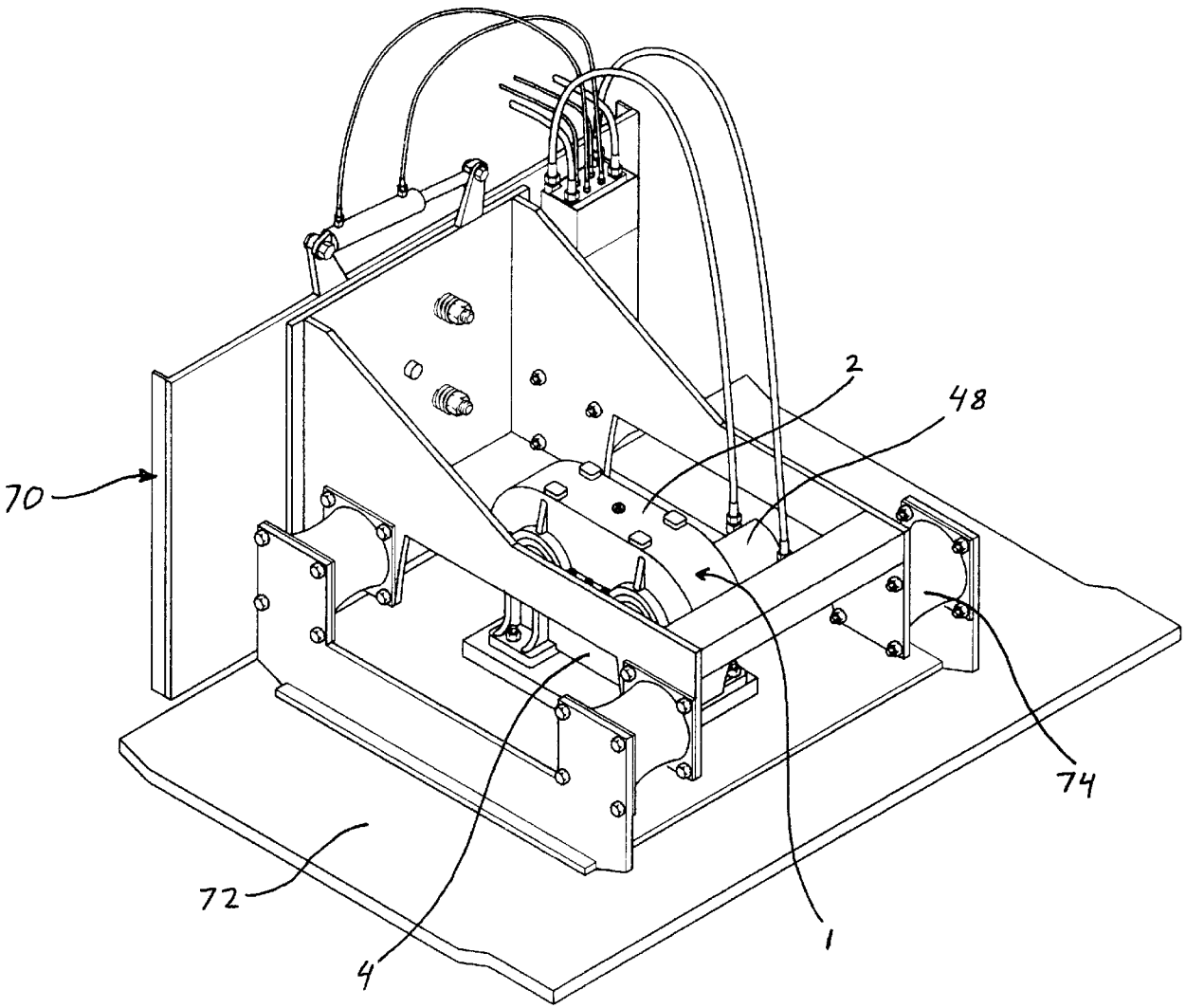
FIG. 5 depicts an alternate exemplary use of the present inventive vibrating mechanism.

Referring simultaneously to FIGS. 4 and 5, the vibrating mechanism 1 may be conveniently removed from the compaction plate 56 of compactor 58 by removing bolts 54. The vibrating mechanism 1 may then be reinstalled within, for example, an auxiliary skid steer compactor 70. As in the boom arm compactor 58, vibratory motion of the vibrating mechanism 1 is transmitted to the compaction plate 72 while transmission of such vibratory motion from the skid steer compactor 70 to lift arms of a skid steer (not shown in view) is minimized by rubber shock absorbing mounts 74.

Through the interchangeability of the vibrating mechanism 1 between different auxiliary earth compactors such as the boom arm compactor 58 and the skid steer compactor 70, cost economies are realized through elimination of a requirement of purchasing and maintaining multiple vibrator assemblies. An alternate advantage is realized where, for example, both the boom arm compactor 58 and the skid steer compactor 70 have installed therein a vibrating mechanism 1, and where one such mechanism is damaged or otherwise rendered non-functional. In such event, the other vibrating mechanism may be transferred allowing both compactors to be alternately functional.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A vibrating mechanism comprising:

(a) a housing having a lower end and having an interior space, the housing comprising an oblongated downwardly opening cap having a lower lip and an oblongated upwardly opening bowl having an upper lip; the lower lip of the oblongated downwardly opening cap being fitted so that it may be placed in contact with and fixedly attached to the upper lip of the oblongated upwardly opening bowl;

(b) a wheel having a plane of rotation extending therethrough; the wheel having an axis of rotation extending axially therethrough, the axis of rotation perpendicularly intersecting the plane of rotation; the wheel having a center of gravity, the center of gravity of the wheel being radially removed from the axis of rotation; the wheel having an outer radial surface; and the wheel having a multiplicity of teeth extending radially outward from its outer radial surface;

(c) rotatable mounting and positioning means mounting and positioning the wheel within the interior space of the housing so that the plane of rotation intersects the lower end of the housing; the rotatable mounting and and positioning means comprising a drive axle receiving channel extending axially through the wheel, and a drive axle extending through the drive axle receiving channel, the upper and lower lips of the cap and bowl being fitted for rotatably receiving and retaining the drive axle;

(d) means for alternately fixedly attaching the housing to and removing the housing from an earth compacting machine, said means being fixedly attached to the housing; and, (e) a gear, the gear having an axis of rotation and a center of gravity, the center of gravity of the gear being radially removed from the axis of rotation of the gear; the gear being rotatably mounted and positioned within the interior space of the housing so that upon rotation of the wheel, its teeth engage and counter-rotate the gear.

2. The vibrating mechanism of claim 1 wherein the oblongated upwardly opening bowl comprises a lubrication reservoir, and further comprising lubricating fluid within such reservoir.

3. The vibrating mechanism of claim 2 wherein the lubricating fluid reservoir has a removably plugged fluid outlet aperture.

4. The vibrating mechanism of claim 3 wherein the oblongated downwardly opening cap has a removably plugged fluid inlet aperture.

* * * * *